US010486434B2

(12) United States Patent
Mori et al.

(10) Patent No.: US 10,486,434 B2
(45) Date of Patent: Nov. 26, 2019

(54) BOBBIN FOR THERMAL TRANSFER SHEET OR IMAGE-RECEIVING SHEET, ASSEMBLY OF BOBBIN AND SHEET, AND THERMAL TRANSFER PRINTER

(71) Applicant: Dai Nippon Printing Co., Ltd., Tokyo (JP)

(72) Inventors: Shigeta Mori, Tokyo (JP); Kenichi Hirota, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/773,252

(22) PCT Filed: Nov. 29, 2016

(86) PCT No.: PCT/JP2016/085450

§ 371 (c)(1),
(2) Date: May 3, 2018

(87) PCT Pub. No.: WO2017/094735

PCT Pub. Date: Jun. 8, 2017

(65) Prior Publication Data

US 2018/0326742 A1 Nov. 15, 2018

(30) Foreign Application Priority Data

Nov. 30, 2015 (JP) ..... 2015-233382

(51) Int. Cl.
*B41J 2/325* (2006.01)
*B41J 17/24* (2006.01)
(Continued)

(52) U.S. Cl.
CPC ..... *B41J 2/325* (2013.01); *B41J 17/24* (2013.01); *B41J 32/00* (2013.01); *B41J 33/22* (2013.01);
(Continued)

(58) Field of Classification Search
CPC ... B41J 2/325; B41J 32/00; B41J 17/24; B41J 2202/30; B41J 33/00; B41J 33/14;
(Continued)

(56) References Cited

U.S. PATENT DOCUMENTS 4,892,425 A 1/1990 Shimizu et al.
2002/0021926 A1 2/2002 Yamamoto et al.

FOREIGN PATENT DOCUMENTS

CN 204280784 U 4/2015
EP 0 389 947 A1 10/1990
(Continued)

OTHER PUBLICATIONS

International Search Report and Written Opinion (Application No. PCT/JP2016/085450) dated Jan. 24, 2017.
(Continued)

*Primary Examiner* — Kristal Feggins
(74) *Attorney, Agent, or Firm* — Burr & Brown, PLLC

(57) ABSTRACT

The present invention makes it possible to reduce the number of constituent components, and to provide a bobbin body having a smooth surface.
A bobbin for a thermal transfer sheet or an image-receiving sheet includes a cylindrical bobbin body 11, wherein a gear 12 including a plurality of teeth 13 is formed on one side end of the bobbin body 11. Each tooth 13 of the gear 12 has a parallelogram shape as a whole, when viewed from a lateral side.

14 Claims, 7 Drawing Sheets

(51) Int. Cl.

| | |
|---|---|
| ***B65H 75/10*** | (2006.01) |
| ***B65H 75/18*** | (2006.01) |
| ***B41J 32/00*** | (2006.01) |
| ***B41J 33/22*** | (2006.01) |
| ***B65H 75/30*** | (2006.01) |

(52) U.S. Cl.
CPC ..... *B65H 75/10* (2013.01); *B65H 75/18* (2013.01); *B65H 75/30* (2013.01); *B41J 2202/30* (2013.01)

(58) Field of Classification Search
CPC ... B41J 33/16; B41J 31/02; B41J 31/04; B41J 31/05; B41J 31/00; B41J 33/18; B41J 33/20; B41J 33/22; B41J 33/24; B65H 75/10; B65H 75/18
See application file for complete search history.

(56) References Cited

FOREIGN PATENT DOCUMENTS

| | | | |
|---|---|---|---|
| JP | S61-277540 | A | 12/1986 |
| JP | S63-170058 | A1 | 7/1988 |
| JP | H03-031152 | A | 2/1991 |
| JP | H09-020043 | A | 1/1997 |
| JP | H10-129067 | A1 | 5/1998 |
| JP | H10-252767 | A | 9/1998 |
| JP | 2001-122523 | A1 | 5/2001 |
| JP | 2001-150775 | A1 | 6/2001 |
| JP | 2004-291392 | A | 10/2004 |
| JP | 2006-315273 | A1 | 11/2006 |
| JP | 2007-168225 | A | 7/2007 |

OTHER PUBLICATIONS

Chinese Office Action (with English translation), Chinese Application No. 201680068328.4, dated Mar. 19, 2019 (15 pages).

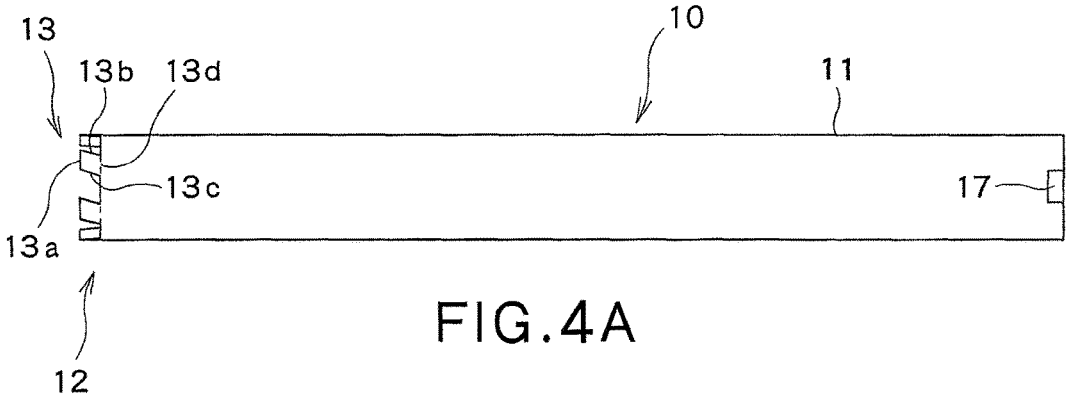
FIG.4A
FIG.4B
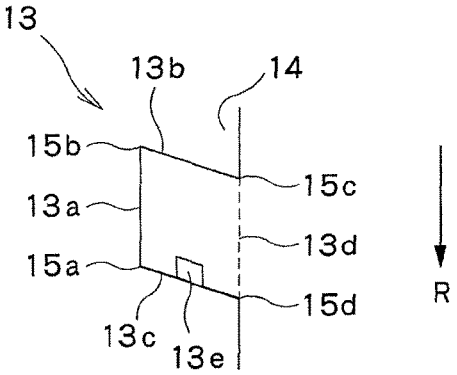
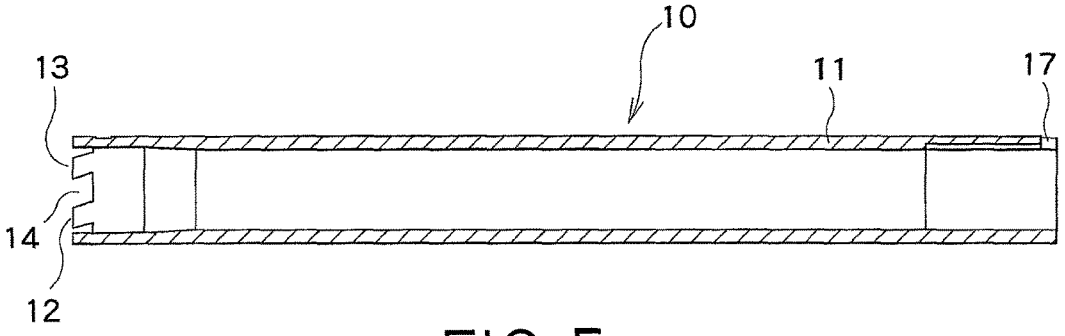
FIG.5

BOBBIN FOR THERMAL TRANSFER SHEET OR IMAGE-RECEIVING SHEET, ASSEMBLY OF BOBBIN AND SHEET, AND THERMAL TRANSFER PRINTER

TECHNICAL FIELD

The present invention relates to a bobbin for a thermal transfer sheet or an image-receiving sheet, a bobbin/sheet assembly, and a thermal transfer printer.

BACKGROUND ART

Thermal transfer printers are widely prevalent which print characters or images on an object, such as an image-receiving sheet, by using an ink ribbon (thermal transfer sheet). The ink ribbon includes a ribbon (support layer) extending in a strip shape, and an ink layer containing a dye, etc. and formed on the ribbon. The ink ribbon is mounted and wound on a bobbin.

The bobbin, on which the ink ribbon is wound, generally includes a bobbin body and a driving flange mounted on the bobbin body as a separate member from the bobbin body. However, the provision of such a driving flange, as a separate member, in a bobbin body increases the number of constituent components and increases the production cost and, in addition, involves a cumbersome operation when disposing of the bobbin.

It is conceivable to form driving irregularities in the outer surface of a bobbin body. However, when winding a ribbon on the bobbin, a rubber touch roll pressing on the ribbon may come into contact with the driving irregularities, resulting in the formation of scratches on the touch roll.

PRIOR ART DOCUMENTS

Patent Document 1: JP2001-122523A
Patent Document 2: JP2001-150775A

SUMMARY OF THE INVENTION

Problems to be Solve by the Invention

The present invention has been made in view of the above situation. It is therefore an object of the present invention to provide a bobbin for a thermal transfer sheet or an image-receiving sheet, an assembly of a bobbin and a sheet, and a thermal transfer printer which can reduce the number of constituent components and can avoid scratching on a touch roller.

Means for Solving the Problems

The present invention is a bobbin for a thermal transfer sheet or an image-receiving sheet, comprising a cylindrical bobbin body, wherein: a gear including a plurality of teeth is formed on one side end of the bobbin body; and each tooth has a parallelogram shape as a whole, when the bobbin body is viewed from a lateral side.

The present invention is the bobbin for a thermal transfer sheet or an image-receiving sheet, wherein two sides of the parallelogram shape of each tooth extends perpendicularly to an axis line of the bobbin body.

The present invention is the bobbin for a thermal transfer sheet or an image-receiving sheet, wherein one side of the parallelogram shape of each tooth has a groove portion formed therein.

The present invention is the bobbin for a thermal transfer sheet or an image-receiving sheet, wherein each side of the parallelogram shape of each tooth is curved.

The present invention is the bobbin for a thermal transfer sheet or an image-receiving sheet, wherein each corner of the parallelogram shape of each tooth is chamfered.

The present invention is the bobbin for a thermal transfer sheet or an image-receiving sheet, wherein the bobbin body is provided, on a surface of the other side end thereof, with an engagement groove that performs a positioning function when mounting a flange part.

The present invention is an assembly of a bobbin and a sheet, comprising: the bobbin for a thermal transfer sheet or an image-receiving sheet as described above; and a thermal transfer sheet or an image-receiving sheet wound on the bobbin.

The present invention is the assembly of a bobbin and a sheet, further comprising a case for housing the bobbin and the thermal transfer sheet or the image-receiving sheet.

The present invention is a thermal transfer printer incorporating the assembly of a bobbin and a sheet as described above, the thermal transfer printer comprising: a mounting unit on which the assembly of a bobbin and a sheet is mounted; and a drive shaft or a brake shaft extending coaxially with the bobbin body; wherein the drive shaft or the brake shaft has, on an end surface thereof, a drive unit having a drive gear or a brake unit having a brake gear to be engaged with the gear of the bobbin body.

Effects of the Invention

The present invention makes it possible to reduce the number of constituent components, and to provide a bobbin body having a smooth outer surface without any driving irregularities.

BRIEF DESCRIPTION OF THE DRAWINGS

FIG. 4A is a side view of a supply bobbin, and FIG. 4B is an enlarged view of the supply bobbin;

FIG. 5 is a cross-sectional side view of the supply bobbin;

DESCRIPTION OF THE PREFERRED EMBODIMENTS

Embodiment

An embodiment of the present invention will now be described with reference to the drawings.

FIGS. 1 to 8 are views illustrating the embodiment of the present invention.

Figure 1:
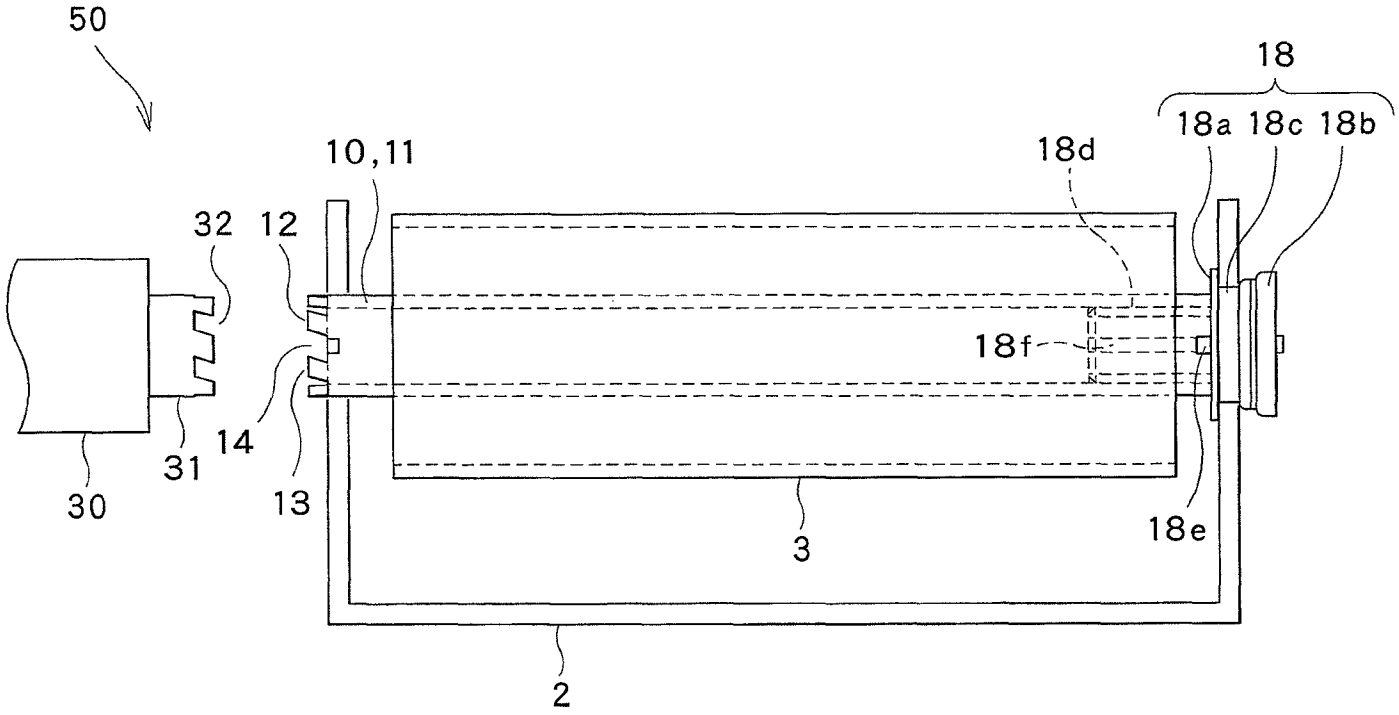
FIG. 1 is a side view of a bobbin for a thermal transfer sheet or an image-receiving sheet according to the present invention.
Figure 2:
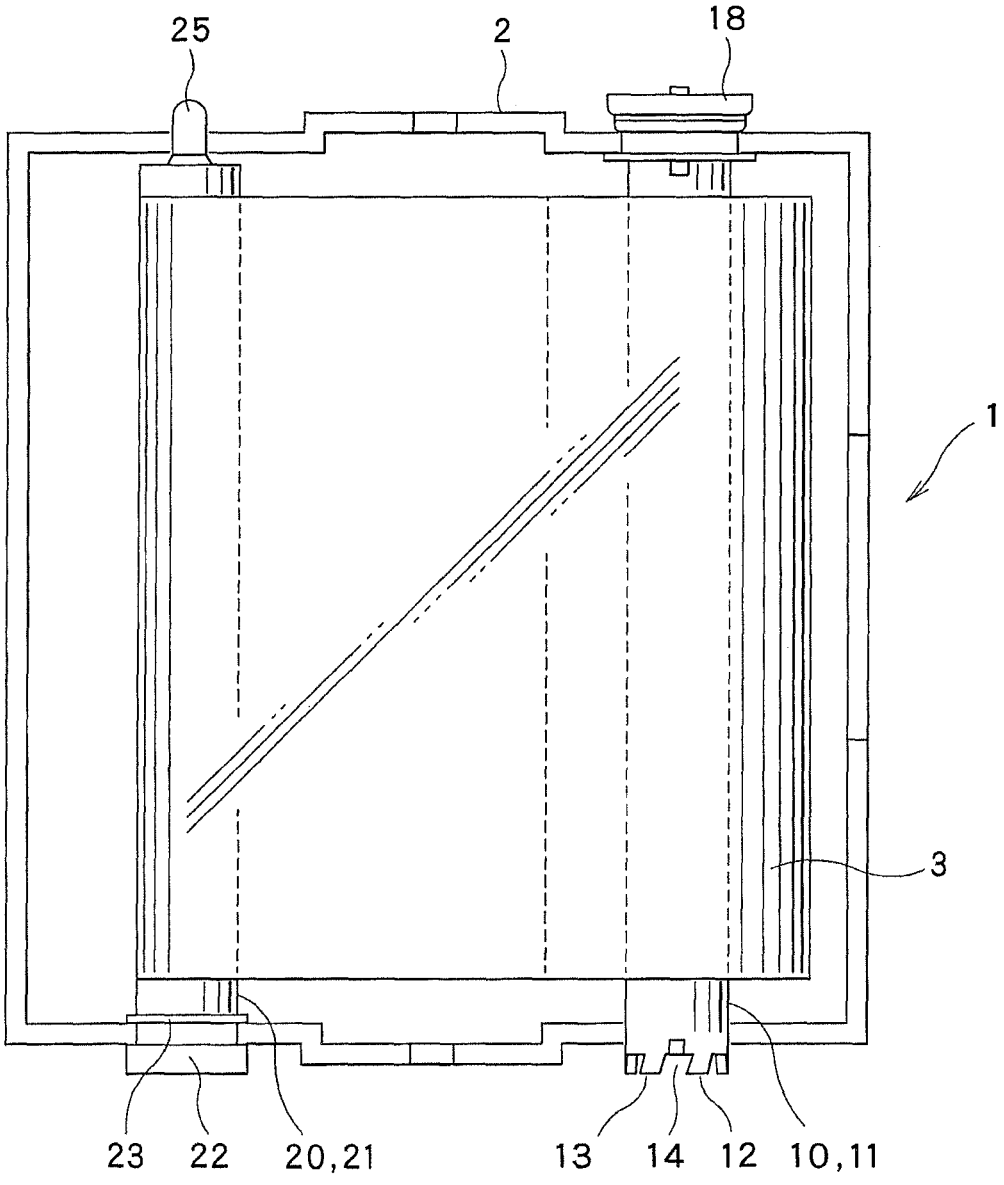
FIG. 2 is a plan view of an assembly of a sheet and bobbins.

At the outset, a ribbon cartridge (assembly of bobbins and a sheet) 1 incorporating a bobbin 10 for a thermal transfer sheet or an image-receiving sheet according to the present invention is described with reference to FIG. 2.

The ribbon cartridge 1 includes a supply bobbin 10, a take-up bobbin 20, a case 2 for housing the supply bobbin 10 and the take-up bobbin 20, and an ink ribbon (thermal transfer sheet) 3 having a support layer and an ink layer, provided between the supply bobbin 10 and the take-up bobbin 20. The ink ribbon 3 is fixed on the supply bobbin 10 and on the take-up bobbin 20, respectively.

The take-up bobbin 20 of the ribbon cartridge 1 having such a structure includes a cylindrical bobbin body 21, a gear flange 22 formed integrally with the bobbin body 21 at one side end of the bobbin body 21, and a support shaft 25 formed integrally with the bobbin body 21 at the other side rend of the bobbin body 21. Herein, the "one side end of the bobbin body 21" means the whole one side end of the bobbin body 21 in an axial direction thereof, and the "other side end of the bobbin body 21" means the whole other side end of the bobbin body 21 in the axial direction.

Figure 3:
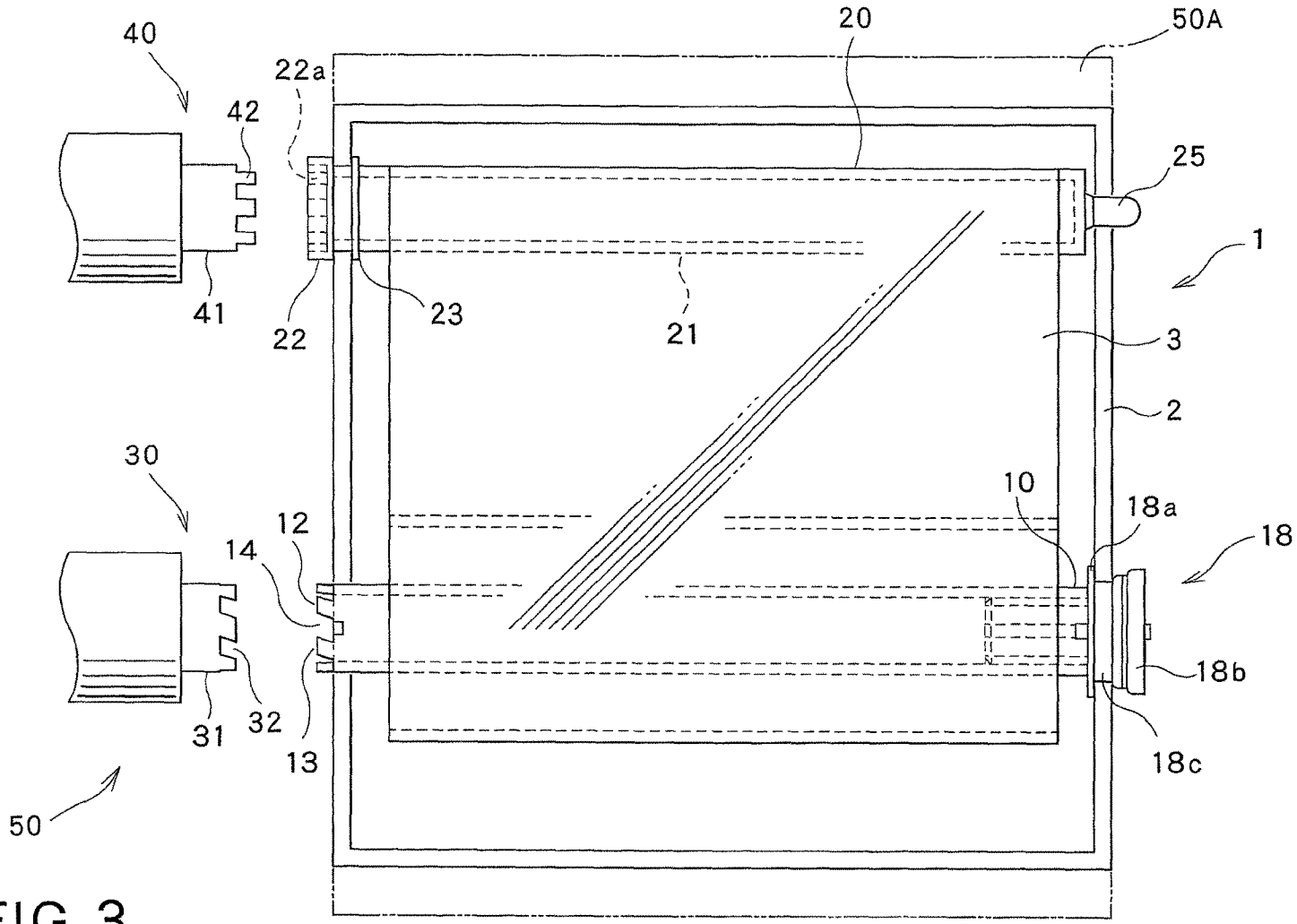
FIG. 3 is a plan view of the assembly of a sheet and bobbins set in a thermal transfer printer.
Figure 6:
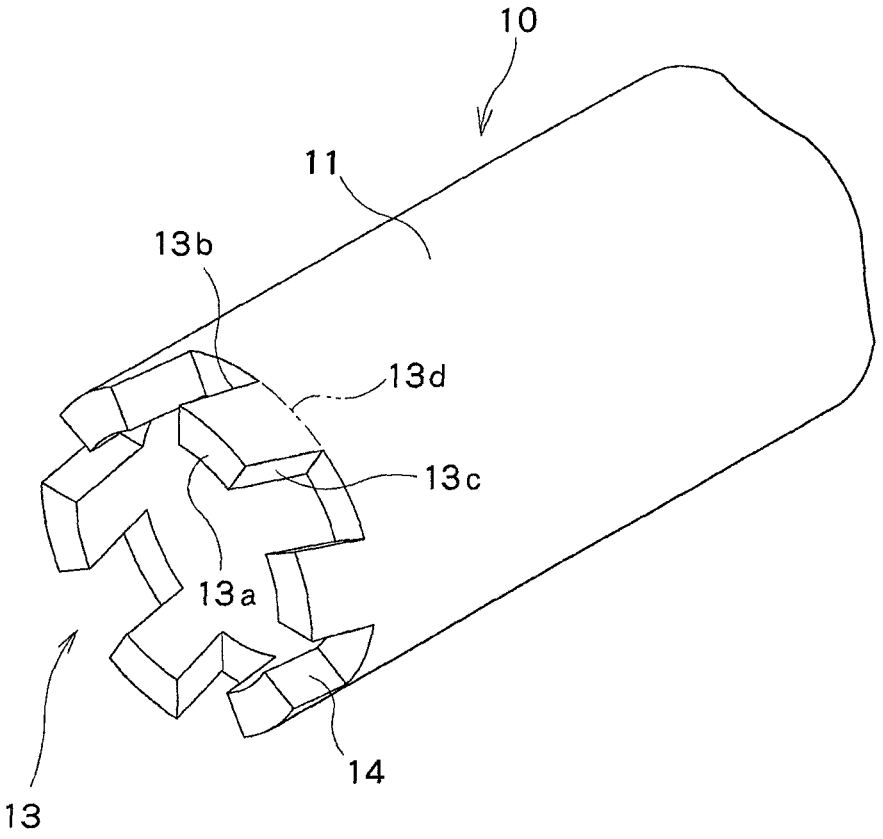
FIG. 6 is a perspective view of the supply bobbin.

The gear flange 23 has a plurality of teeth 22*a* formed in an inner circumferential surface thereof. The teeth 22*a* formed in the inner circumferential surface are engaged with a drive unit 40 of the thermal transfer printer 50 so that the drive unit 40 drives the take-up bobbin 20 in rotation (see FIG. 3). As shown in FIG. 3, the bobbin body 21 of the take-up bobbin 20 has a circumferential projection 23 in the vicinity of the gear flange 22. A portion of the bobbin body 21, which lies between the gear flange 22 and the circumferential projection 23, is engaged with the case 2, whereby the take-up bobbin 20 is located in position along the axial direction within the case 2.

The drive unit 40 of the thermal transfer printer 50 includes a drive shaft 41. A drive gear 42, which is engaged with the teeth 22*a* of the gear flange 22, is formed on an end of the drive shaft 41.

The supply bobbin 10 (bobbin for a thermal transfer sheet or an image-receiving sheet according to the present invention) of the ribbon cartridge 1 is described in detail with reference to FIGS. 1 to 8. The supply bobbin 10 includes a cylindrical bobbin body 11 having a gear 12 formed on its one side end. The gear 12 has a plurality of teeth 13 and tooth groves 14 formed between the teeth 13. As described below, the gear 12 is engaged with a brake gear 32 of a brake shaft 31 provided on a brake unit 30 of the thermal transfer printer 50. Herein, the "one side end of the bobbin body 11" means the whole one side end of the bobbin body 11 in an axial direction thereof, and the "other side end of the bobbin body 11" means the whole other side end of the bobbin body 11 in the axial direction.

A plurality of engagement grooves 17 are formed in the other side end of the bobbin body 11. When a flange part 18 is mounted on the other side of the bobbin body 11, engagement projections 18*e* of the flange part 18 are configured to be engaged with the engagement grooves 17.

The supply bobbin 10 is described in detail with reference to FIGS. 4A, 4B to 8. As described above, the supply bobbin 10 includes the cylindrical bobbin body 11 having the gear 12 on one side end of the bobbin body 11. The gear 12 has the teeth 13 and the tooth grooves 14 formed between the teeth 13. Each tooth 13 has a parallelogram shape as a whole with four corners 15*a*, 15*b*, 15*c* and 15*d*, and four sides 13*a*, 13*b*, 13*c* and 13*d* (see FIGS. 4A and 4B), when viewed from a lateral surface of the bobbin body 11. Herein, the expression "when viewed from the lateral side" means that the bobbin body 11 is viewed from the side perpendicular to the axial direction of the bobbin body 11.

As described above, each tooth 13 has a parallelogram shape which has four corners 15*a*, 15*b*, 15*c* and 15*d*, and the sides 13*a*, 13*b*, 13*c* and 13*d*: the side 13*a* being formed between the corners 15*a* and 15*b*, the side 13*b* being formed between the corners 15*b* and 15*c*, a side 13*c* being formed between the corners 15*a* and 15*d*, and the side 13*d* being formed between the corners 15*c* and 15*d*.

The side 13*d* of the respective sides 13*a*, 13*b*, 13*c* and 13*d* is a virtual side that does not constitute an outer surface of the gear 12. The sides 13*a* and 13*d* of the respective sides 13*a*, 13*b*, 13*c* and 13*d* extend perpendicularly to an axis line of the bobbin body 11. Further, the sides 13*b* and 13*c* are inclined with respect to the axis line of the bobbin body 11.

The brake gear 32 to be engaged with the gear 12 has recessed portions of a shape corresponding to the parallelogram shape of each tooth 13, in order to reliably receive the respective teeth 13 of the gear 12.

In addition, since the sides 13*a* and 13*d* extend perpendicularly to the axis line of the bobbin body 11, the respective teeth 13 of the gear 12 can be more reliably received.

In addition, each of the four corners 15*a*, 15*b*, 15*c* and 15*d* of each tooth 13 has a chamfered curved surface. Further, each of the sides 13*a*, 13*b*, 13*c* and 13*d* of each tooth 13 is curved to be outwardly convex. In addition, the side 13*c* has an inwardly facing groove portion 13*e* formed therein. In this case, due to the formation of the groove portion 13*e*, the gear 12 and the respective teeth 13 can be more securely engaged with each other.

Since each of the four corners 15*a*, 15*b*, 15*c* and 15*d* of each tooth 13 has a chamfered curved surface, and each of the sides 13*a*, 13*b*, 13*c* and 13*d* of each tooth 13 is curved to be outwardly convex, the tooth 13 has curved surfaces as a whole. Thus, there is no possibility that an operator who operates the bobbins 10 and 20 is scratched by the supply bobbin 10.

In addition, since each tooth 13 of the gear 12 has a parallelogram shape with the four corners 15*a*, 15*b*, 15*c* and 15*d*, and the brake gear 32 to be engaged with the gear 12 has the recessed portions of a shape corresponding to the parallelogram shape of each tooth 13, the respective teeth 13 of the gear 12 and the recessed portions of the brake gear 32 can be securely engaged with each other. In this case, since the parallelogram shape of each tooth 13 has the sides 13*b* and 13*c* that are inclined with respect to the axis line direction of the bobbin body 11, a rotational force in a direction R about the axis line of the bobbin body 11 can be reliably transmitted from the brake gear 32 to the gear 12.

The thus-constructed bobbin body 11 is disposed coaxially with the brake shaft 31 of the thermal transfer printer, and can reliably brake the bobbin body 11 by the brake shaft 31 through the brake gear 32 and the gear 12.

Figure 7:
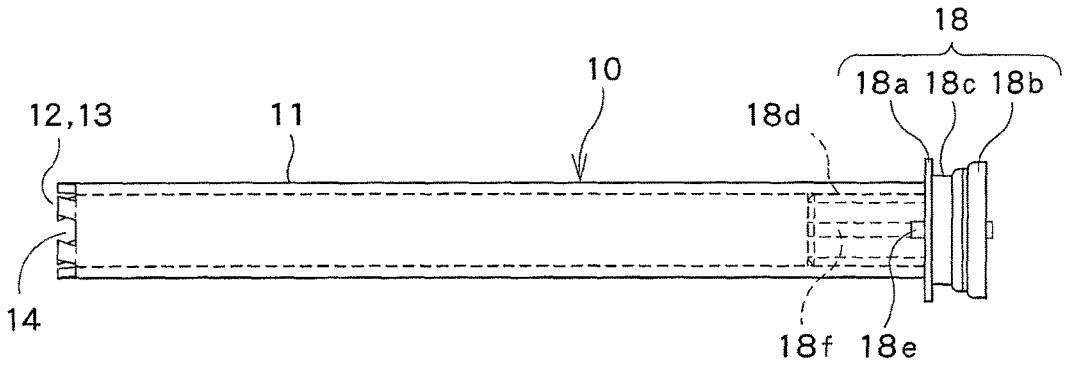
FIG. 7 is a side view of the supply bobbin having a flange part.
Figure 8:
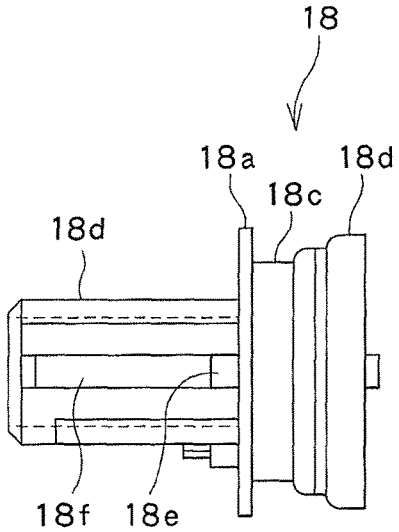
FIG. 8 is a side view of the flange part.

Next, the flange prat 18 to be mounted on the bobbin body 11 is described. As shown in FIGS. 7 and 8, the flange part 18 is to be mounted on the other side of the bobbin body 11, and includes a first flange 18*a*, a second flange 18*b*, and an engagement portion 18*c* which is formed between the first flange 18*a* and the second flange 18*b* and is engaged with the case 2. A cylindrical portion 18*d*, which is to be inserted into the bobbin body 11, is coupled to the first flange 18*a*.

In addition, the engagement projections 18*e*, which are to be engaged with the engagement grooves 17 of the bobbin body 11, are provided on the cylindrical portion 18*d* of the flange part 18 at positions adjacent to the first flange 18*a*.

The cylindrical portion 18*d* of the flange part 18 is provided with axial ribs 18*f* whose projecting height is lower than the height of the engagement projections 18*e* and which extend in the axial direction. The axial ribs 18*f* of the flange part 18 are configured to be engaged with axial grooves (not shown) formed in the inner surface of the bobbin body 11.

The thus-constructed flange part 18 is formed as a separate member from the bobbin body 1, and is mounted on the bobbin body 11. In this manner, the supply bobbin 10 is constructed.

The flange part 18 has a built-in RFID for identifying the type of the ink ribbon 3 to be supplied.

Next, an operation of the embodiment as structured above is described.

Firstly, the supply bobbin 10 with the ink ribbon 3 wound thereon, and the take-up bobbin 20 are prepared. When the ink ribbon 3 is wound on the supply bobbin 10, the ink ribbon 3 is kept pressed against the supply bobbin 10 by means of a touch roller.

Then, the supply bobbin 10 and the take-up bobbin 20 are set in the case 2, thereby obtaining the ribbon cartridge (the assembly of bobbins and a sheet) 1 including the case 2, the supply bobbin 10 with the ink ribbon 3 wound thereon, and the take-up bobbin 20.

Then, the ribbon cartridge 1 is mounted on a mounting unit 50A of the thermal transfer printer 50. In this case, the take-up bobbin 20 of the ribbon cartridge 1 aligns coaxially with the drive shaft 41 of the drive unit 40 of the thermal transfer printer 50, while the supply bobbin 10 aligns coaxially with the brake shaft 31 of the brake shaft 30 of the thermal transfer printer.

Then, the drive unit 40 is pressed against the take-up bobbin 20, whereby the drive gear 42 of the drive unit 40 is engaged with the gear flange 22 (the teeth 22*a* formed in the inner circumferential surface) of the take-up bobbin 20.

Similarly, the brake unit 30 is pressed against the supply bobbin 10, whereby the brake gear 32 formed on the brake shaft 31 of the brake unit 30 is engaged with the gear 12 of the supply bobbin 10.

At this time, since the teeth 13 of the gear 12 each have a parallelogram shape when viewed from the lateral side, the brake gear 32 of the brake unit 30 and the gear 12 of the supply bobbin 10 can be engaged with each other easily and simply, only by pressing the brake unit 30 against the supply bobbin 10 so that any of the brake gear 32 of the brake unit 30 and the gear 12 of the supply bobbin 10 is slightly rotated.

Then, the take-up bobbin 20 is driven by the drive unit 40, and the supply bobbin 10 is braked by a brake (not shown) built in the brake unit 30. In this manner, the ink ribbon 3 wound on the supply bobbin 10 is supplied. Then, the ink ribbon 3, which extends between the supply bobbin 10 and the take-up bobbin 20, is heated by a thermal head (not shown), whereby the ink of the ink ribbon 3 is transferred onto an image-receiving sheet (not shown). A thermal transfer operation is performed in this manner.

As described above, according to this embodiment, since the gear 12 including the teeth 13 is formed on one side end of the bobbin body 11 of the supply bobbin 10, the brake gear 32 of the brake unit 30 of the thermal transfer printer 50 can be directly engaged with the gear 12. Thus, the driving force in the rotational direction from the brake shaft 31 of the brake unit 30 can be directly transmitted to the bobbin body 11.

Accordingly, there is no need to provide the bobbin body 11 with a flange that is engaged with the brake shaft 31, resulting in reduction of the number of components. Furthermore, there is no need to provide driving irregularities to be engaged with the brake shaft 31 of the brake unit 30, on the outer surface of the bobbin body 11. The outer surface of the bobbin body 11 can therefore be a smooth surface. This can avoid scratching on a rubber touch roller which is used to wind the ink ribbon 3 on the supply bobbin 10.

In addition, since the teeth 13 of the gear 12 each have a parallelogram shape as a whole, when viewed from the lateral side, the gear 12 and the brake gear 32 of the brake unit 30 can be engaged with each other easily and simply, only by pressing the brake unit 30 against the gear 12.

Modification Examples

Next, modification examples of the present invention are described with reference to FIGS. 9 and 10.

In the embodiment shown in FIGS. 1 to 8, the flange part 18 is mounted on the other side end of the bobbin body 11 of the supply bobbin 10. However, the present invention is not limited thereto. For example, as shown in FIG. 9, it is possible to provide a circumferential groove 28, which is engaged with the case 2 to perform positioning of the supply bobbin 10, on the other side end of the bobbin body 11.

Figure 9:
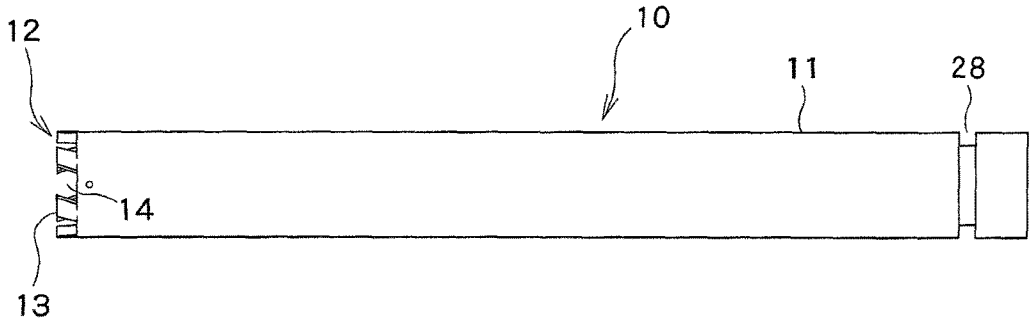
FIG. 9 is a side view of a bobbin body according to a modification example of the present invention.

As shown in FIG. 9, similarly to the embodiment shown in FIGS. 1 to 8, the gear 12, which includes the teeth 13 and the tooth grooves 14 formed between the teeth 13, is formed on the one side end of the bobbin body 11.

As shown in FIG. 9, since the supply bobbin 10 consists solely of the bobbin body 11 and has no flange part, the number of constituent components can be further reduced.

In addition, in the embodiment shown in FIGS. 1 to 8, the flange part 18 is mounted on the other side end of the bobbin body 11 of the supply bobbin 10. However, the present invention is not limited thereto. For example, as shown in FIG. 10, it is possible to provide a pair of circumferential projections 29, which are engaged with the case 2 to perform positioning of the supply bobbin 10, on the other side end of the bobbin body 11.

Figure 10:
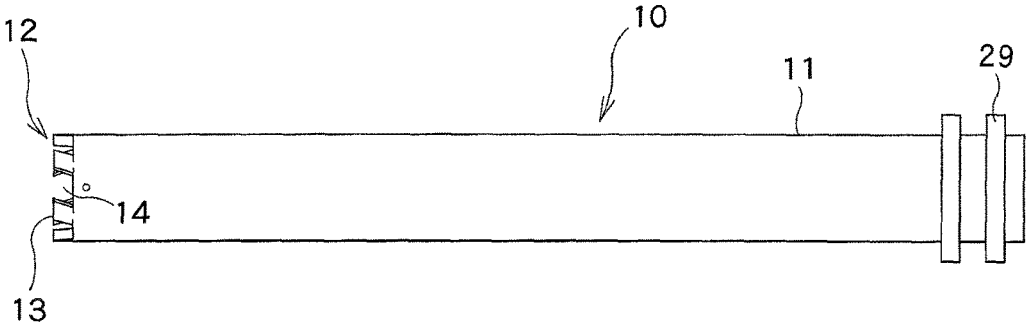
FIG. 10 is a side view of a bobbin body according to a modification example of the present invention.

As shown in FIG. 10, similarly to the embodiment shown in FIGS. 1 to 8, the gear 12, which includes the teeth 13 and the tooth grooves 14 formed between the teeth 13, is formed on the one side end of the bobbin body 11.

As shown in FIG. 10, since the supply bobbin 10 consists solely of the bobbin body 11 and has no flange part, the number of constituent components can be further reduced.

In the above-described embodiment, the ink ribbon (thermal transfer sheet) 3 is wound on the supply bobbin 10 and the take-up bobbin 20. However, it is possible to wind an image-receiving sheet on the supply bobbin 10 and the on the take-up bobbin 20 in order that the supply bobbin 10 and the take-up bobbin 20 can be used as bobbins for an image-receiving sheet.

DESCRIPTION OF THE REFERENCE NUMERALS

1 ribbon cartridge
2 case
3 thermal transfer sheet (ink ribbon)
10 supply bobbin
11 bobbin body
12 gear
13 tooth
13*a*, 13*b*, 13*c*, 13*d* side
31*f* groove portion
15*a*, 15*b*, 15*c*, 15*d* corner
17 engagement groove
20 take-up bobbin
21 bobbin body
22 gear flange

30 brake unit
31 brake shaft
32 brake gear
40 drive unit
41 drive shaft
42 drive gear
50 thermal transfer printer
50A mounting unit

The invention claimed is:

1. A bobbin for a thermal transfer sheet or an image-receiving sheet, comprising a cylindrical bobbin body, wherein:

a gear including at least one tooth is formed on one side end of the bobbin body; and the at least one tooth has a substantially parallelogram shape, when the bobbin body is viewed from a lateral side, wherein a first side of the at least one tooth extends substantially perpendicular to an axis line of the bobbin body, a second side of the at least one tooth spaced away from the first side extends substantially parallel to the first side and substantially perpendicular to the axis line of the bobbin body, a third side of the at least one tooth extends between respective first ends of the first and second sides and inclined with respect to the axis line of the bobbin body, and a fourth side spaced away from the third side extends between respective second ends of the first and second sides substantially parallel to the third side and inclined with respect to the axis line of the bobbin body.

2. The bobbin for a thermal transfer sheet or an image-receiving sheet according to claim 1, wherein one side of the substantially parallelogram shape of the at least one tooth has a groove portion formed therein.

3. The bobbin for a thermal transfer sheet or an image-receiving sheet according to claim 2, wherein each side of the substantially parallelogram shape of the at least one tooth is curved.

4. The bobbin for a thermal transfer sheet or an image-receiving sheet according to claim 2, wherein each corner of the substantially parallelogram shape of the at least one tooth is chamfered.

5. The bobbin for a thermal transfer sheet or an image-receiving sheet according to claim 2, wherein the bobbin body is provided, on a surface of the other side end thereof, with an engagement groove that performs a positioning function when mounting a flange part.

6. The bobbin for a thermal transfer sheet or an image-receiving sheet according to claim 1, wherein each side of the substantially parallelogram shape of the at least one tooth is curved.

7. The bobbin for a thermal transfer sheet or an image-receiving sheet according to claim 6, wherein each corner of the substantially parallelogram shape of the at least one tooth is chamfered.

8. The bobbin for a thermal transfer sheet or an image-receiving sheet according to claim 6, wherein the bobbin body is provided, on a surface of the other side end thereof, with an engagement groove that performs a positioning function when mounting a flange part.

9. The bobbin for a thermal transfer sheet or an image-receiving sheet according to claim 1, wherein each corner of the substantially parallelogram shape of the at least one tooth is chamfered.

10. The bobbin for a thermal transfer sheet or an image-receiving sheet according to claim 9, wherein the bobbin body is provided, on a surface of the other side end thereof, with an engagement groove that performs a positioning function when mounting a flange part.

11. The bobbin for a thermal transfer sheet or an image-receiving sheet according to claim 1, wherein the bobbin body is provided, on a surface of the other side end thereof, with an engagement groove that performs a positioning function when mounting a flange part.

12. An assembly of a bobbin and a sheet, comprising:

the bobbin for a thermal transfer sheet or an image-receiving sheet according to claim 1; and a thermal transfer sheet or an image-receiving sheet wound on the bobbin.

13. The assembly of a bobbin and a sheet according to claim 12, further comprising a case for housing the bobbin and the thermal transfer sheet or the image-receiving sheet.

14. A thermal transfer printer incorporating the assembly of a bobbin and a sheet according to claim 12, the thermal transfer printer comprising:

a mounting unit on which the assembly of a bobbin and a sheet is mounted; and a drive shaft or a brake shaft extending coaxially with the bobbin body;

wherein the drive shaft or the brake shaft has, on an end surface thereof, a drive unit having a drive gear or a brake unit having a brake gear to be engaged with the gear of the bobbin body.

* * * * *